United States Patent [19]

Cromer et al.

[11] 4,383,150

[45] May 10, 1983

[54] CIRCUIT-INTERRUPTERS HAVING SHUNTING CAPACITANCE AROUND THE SEPARABLE POWER CONTACTS WITH CAPACITANCE DISCONNECTING MEANS THEREFOR

[75] Inventors: Charles F. Cromer, Levelgreen-Penn Township, West Moreland County; Willie B. Freeman, Monroeville, both of Pa.

[73] Assignee: Westinghouse Electric Corp., Pittsburgh, Pa.

[21] Appl. No.: 204,138

[22] Filed: Nov. 5, 1980

Related U.S. Application Data

[63] Continuation of Ser. No. 941,614, Sep. 12, 1978.

[51] Int. Cl.[3] ..... H01H 33/70; H01H 33/66

[52] U.S. Cl. ..... 200/144 AP; 200/148 R; 200/144 B; 200/146 R; 200/145

[58] Field of Search ..... 200/144 AP, 146 R, 148 R, 200/144 B, 148 A, 145, 153 V, 325; 317/13, 14, 18

[56] References Cited

U.S. PATENT DOCUMENTS

| | | | |
|---|---|---|---|
| 2,902,570 | 9/1959 | Roxburgh et al. | 200/146 R |
| 3,114,816 | 12/1963 | Beatty | 200/144 AP |
| 3,174,019 | 3/1965 | Jansson | 200/153 V |
| 3,192,440 | 6/1965 | Baltensperger | 200/144 AP |
| 3,508,022 | 4/1970 | Chabala | 200/146 R |
| 3,524,957 | 8/1970 | Frink | 200/153 V |
| 3,538,278 | 11/1970 | Rathbun | 200/144 AP |
| 3,590,190 | 6/1971 | Colclaser, Jr. et al. | 200/144 AP |
| 3,604,869 | 7/1971 | Wilson | 200/144 AP |
| 3,895,202 | 7/1975 | Okerman et al. | 200/148 A |
| 4,027,123 | 5/1977 | Ihara | 200/145 |
| 4,072,836 | 2/1978 | Bischofberger et al. | 200/144 AP |
| 4,105,880 | 8/1978 | Rapp et al. | 200/148 A |

FOREIGN PATENT DOCUMENTS

| | | |
|---|---|---|
| 366966 | 2/1932 | United Kingdom . |
| 407780 | 3/1934 | United Kingdom . |
| 1391981 | 4/1971 | United Kingdom . |
| 1398633 | 6/1975 | United Kingdom . |
| 1495632 | 12/1977 | United Kingdom . |

*Primary Examiner*—Robert S. Macon
*Attorney, Agent, or Firm*—M. S. Yatsko

[57] ABSTRACT

An improved circuit-interrupter of either the vacuum-type, or of the compressed-gas type, is provided having a shunting capacitance around, or electrically paralleling, the separable power contacts of the main power interrupter. In series with the said electrically-shunting capacitance is capacitor-isolating disconnecting switch, which interrupts the residual capacitance current at a subsequent point in time following the interruption of the main-power current in the main-power interrupting unit.

The present invention may be applied not only to vacuum interrupters, but also to compressed-gas circuit-interrupters of either the double-pressure gas type, or the single-pressure gas type, such as the so-called "puffer" gas type, creating gas flow by relative piston-and-cylinder operation.

14 Claims, 13 Drawing Figures

CLOSED POSITION

FIG. 5
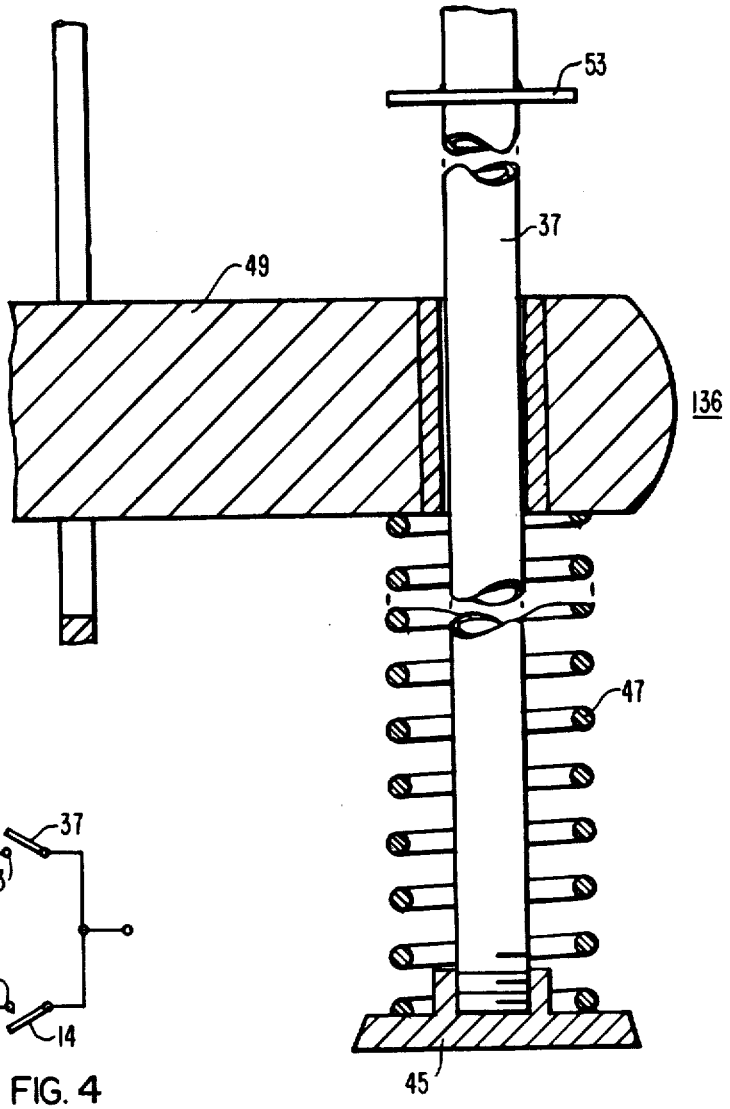
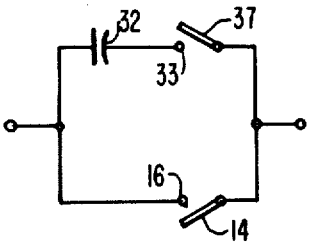
FIG. 4

CIRCUIT-INTERRUPTERS HAVING SHUNTING CAPACITANCE AROUND THE SEPARABLE POWER CONTACTS WITH CAPACITANCE DISCONNECTING MEANS THEREFOR

This is a continuation of application Ser. No. 941,614, filed Sept. 12, 1978.

BACKGROUND OF THE INVENTION

Single-pressure $SF_6$ circuit-interrupters are sensitive to the initial rate of rise of the recovery-voltage transient, which, in turn, is a function of the amplitude and frequency of the current interrupted $di/dt|i=0$.

The initial TRV (Transit Recovery Voltage) can be modified, or the maximum rate-of-rise of recovery voltage transient can be delayed, by adding shunting capacitance to ground, or across the interrupter. The time delay is essentially that of an R-C circuit, in which the "R" represents the surge impedance of the transmission line, or system, and the "C" is that of the added capacitance.

If the capacitance is added to ground, it is energized continuously, and must withstand all voltages at all times. Furthermore, final isolation from the system is made by a slow-acting disconnecting switch, which can produce transients resulting in excessive overvoltages, or false-relay operations. Also, the cost of capacitors may be prohibitive, if applied to both the bus side and to the line side of the circuit-breaker.

However, the capacitance can be added across the interrupter itself resulting in the following important advantages: The capacitor is not energized continuously, it does not affect relay operations when being switched by disconnecting switches, it modifies the initial recovery rate of both line and bus-side transients, it is closer coupled to the circuit-interrupter and therefore more effective, and is generally more economical.

There are also certain disadvantages associated with this type of capacitor application, i.e., the capacitor may couple excessive voltage across the open circuit-breaker, large amounts of capacitance may resonate with series circuit inductances, and the capacitor must withstand the open-circuit, low-frequency, one-minute voltage test.

SUMMARY OF THE INVENTION

In accordance with the principles of the present invention, there is provided a main-power interrupting unit having separable power contacts, such main-power interrupting unit, for example, comprising a vacuum-interrupter "bottle", or unit, or, alternatively, a compressed-gas type of power-unit of either the single, or double-pressure gas type, taken in conjunction with the electrically-shunting capacitance, which has its own capacitance-isolating switch.

The present invention functions to first open the main-power separable contacts, while the capacitance-isolating switch contacts are yet closed, and rendering the main-power circuit easier to interrupt, due to the existence of the electrically-shunting capacitance, which lowers the rate-of-rise of the recovery-voltage transient.

Following the interruption of the main-power current at the main-power interrupting unit (which may assume different forms, as described heretofore), the separable isolating disconnecting contacts of the capacitor-isolating switch open to interrupt the residual shunting capacitance current. Thus, in the fully-open-circuit position of the device, both pairs of separable contacts are in their fully-open-circuit isolating position.

The invention may be applicable to not only a single-unit construction, but for the higher line voltages, where the line voltage may be higher than one unit is capable itself of accommodating. Several power units in electrical series may be utilized, with the separable power contacts thereof operating simultaneously, together with, desirably, a separate shunting voltage-dividing capacitance means, which remains constantly in the circuit, as well understood by those skilled in the art. The function, of course, of this additional shunting capacitance for several power units in series is to equally divide the higher line-voltages among the several series units, so that each individual unit need withstand only its fair share of the overall open-circuit voltage.

BRIEF DESCRIPTION OF THE DRAWINGS

FIG. 4 is a schematic view of the circuit arrangement of FIG. 2;

FIG. 5 is a fragmentary view illustrating a different delaying means for securing a hesitating travel of the movable-capacitor isolating switch contact;

DESCRIPTION OF THE PREFERRED EMBODIMENTS

Figure 1:
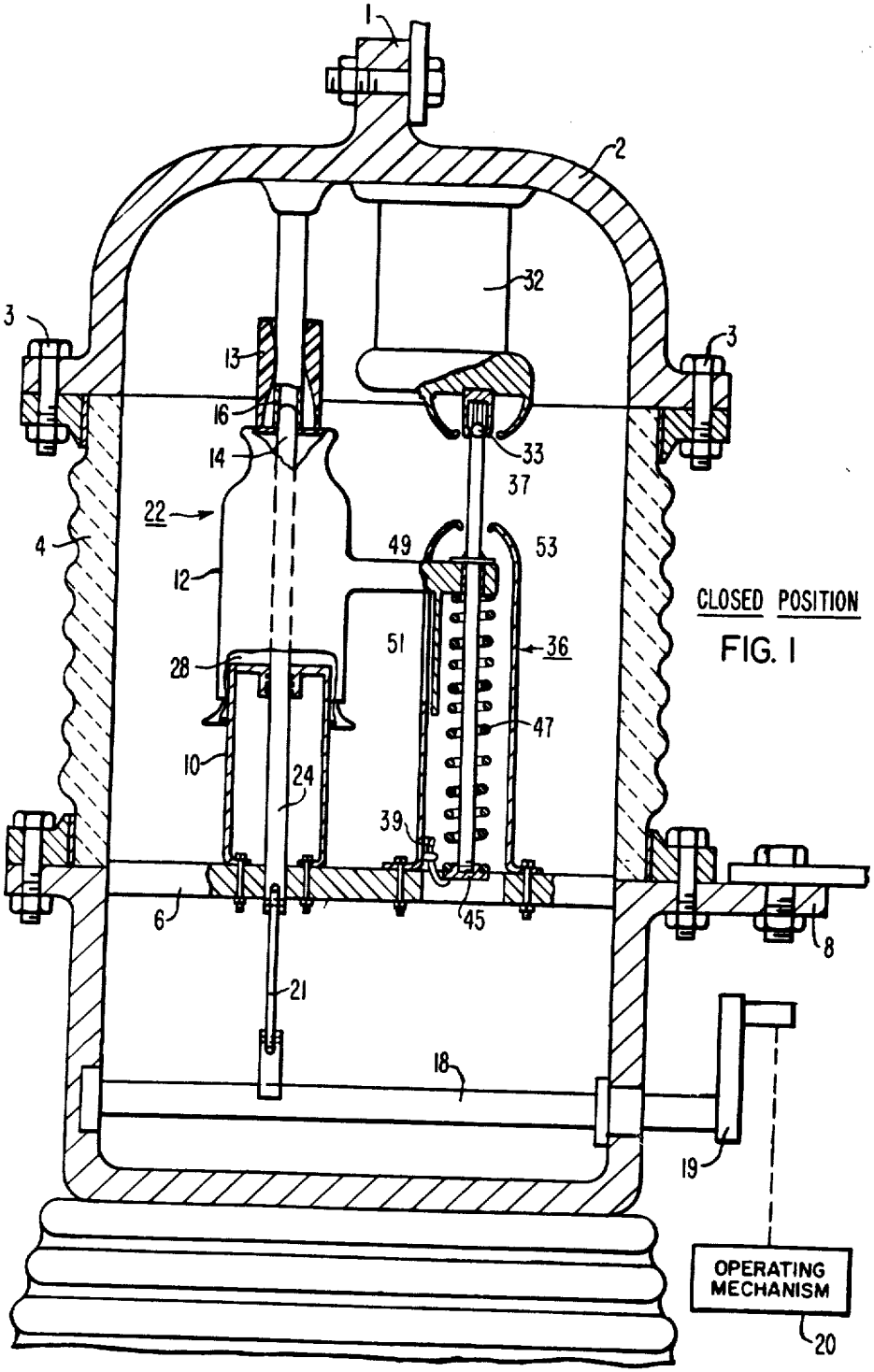
FIG. 1 illustrates an application of the present invention, with the separable power contact structure being illustrated in the closed-circuit position.
Figure 2:
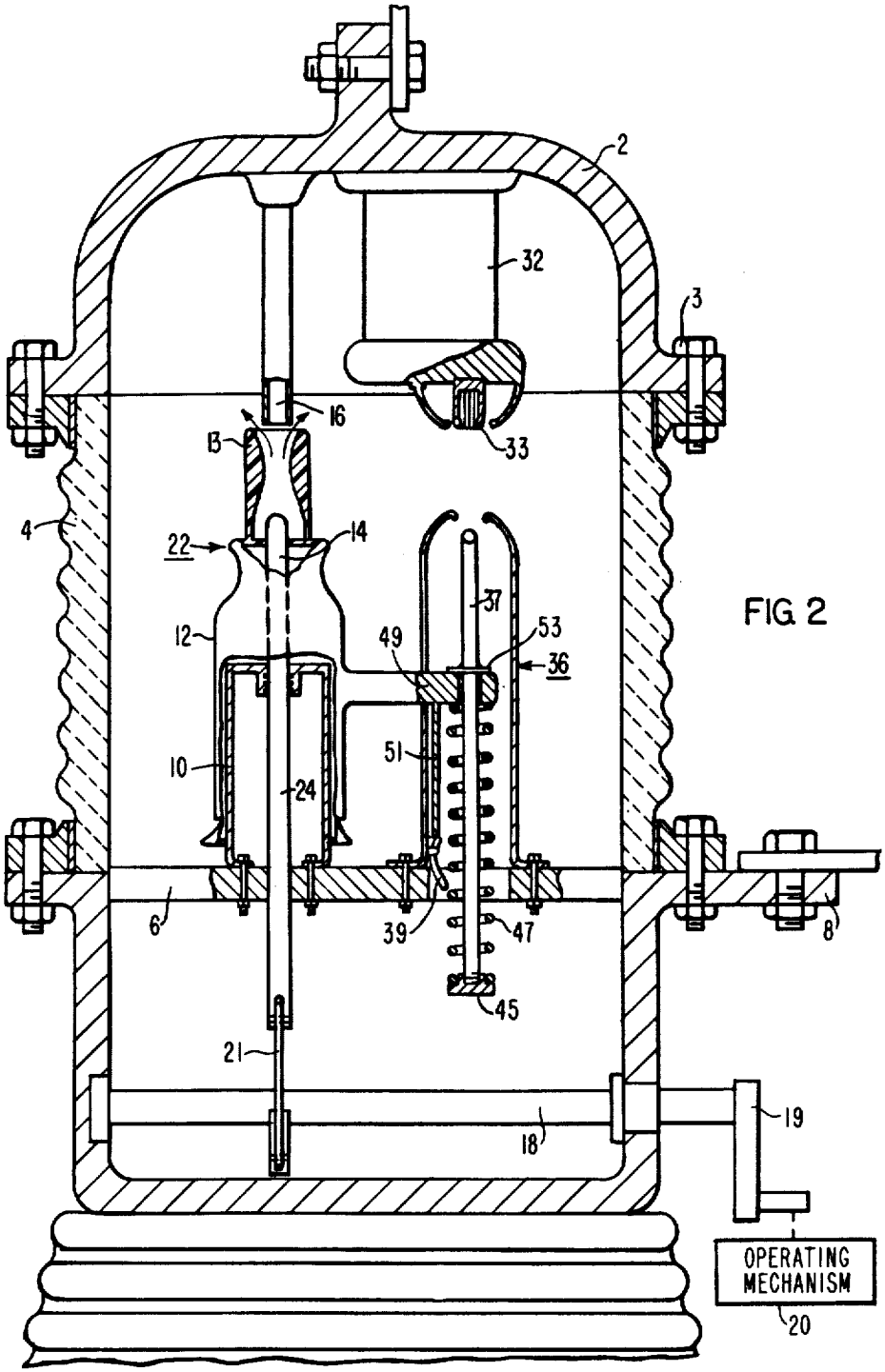
FIG. 2 is a view similar to that of FIG. 1, but illustrating the position of the several contacts in fully open-circuit position of the interrupter.
Figure 3:
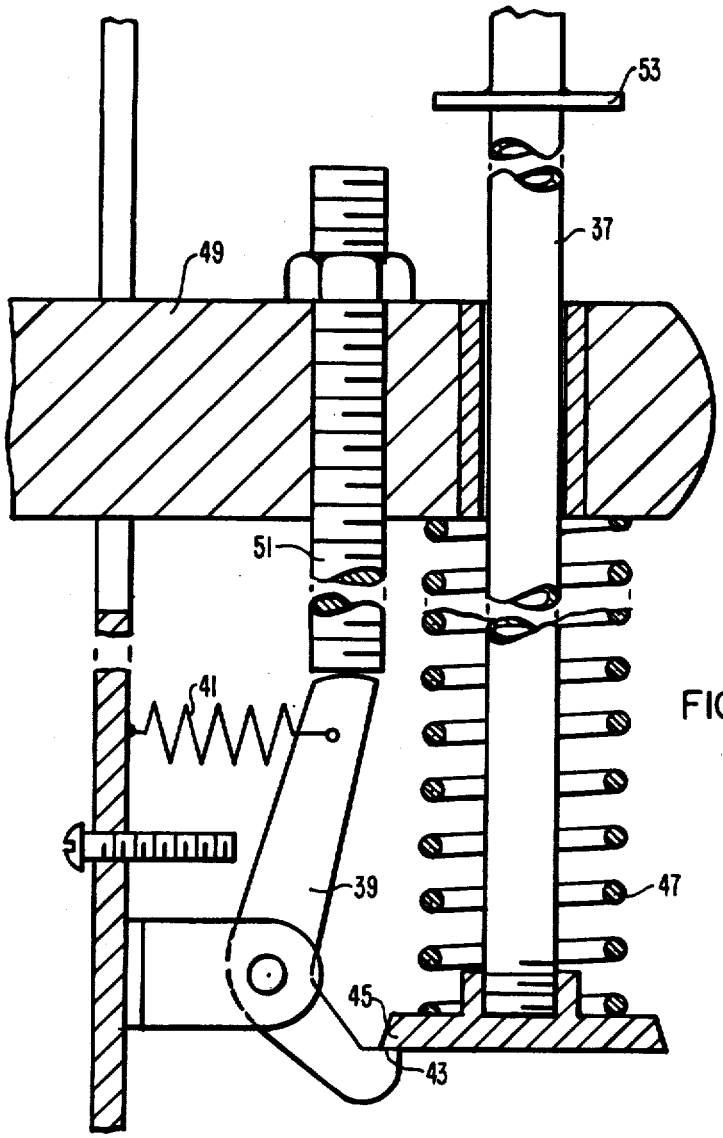
FIG. 3 illustrates, to an enlarged scale, a possible latching arrangement for a circuit-interrupter of the type shown in FIG. 2.

Referring to the drawings, and more particularly to FIGS. 1-3 thereof, it will be observed that there is provided an upper line-terminal connection 1, integrally formed with an upper cap-dome portion 2, the latter being secured by suitable mounting bolts 3 to an upstanding, insulating casing 4, composed of epoxy-resin, or porcelain as desired, together with a lower main supporting plate-member 6, forming a support for a lower line-terminal connection 8, and also a support for a relatively-fixed piston member 10.

Slidable over the relatively-fixed piston member 10 is a movable operating cylinder 12, a movable orifice 13 and a movable contact structure 14, the latter making contacting engagement with a downwardly-extending, relatively-stationary contact 16. It is, of course, understood that although the particular embodiment of the invention illustrates a vertical upstanding arrangement, the invention is not so limited in orientation, and is adaptable obviously to other possible orientations, if desired.

Extending laterally within the interior of the casing structure 4 is a rotatable main operating shaft 18, which has an externally-secured crank-arm 19 operatively connected thereto. The external crank-arm 19 is actuated by an externally-disposed operating mechanism 20 of any suitable type, either hydraulic-acting, solenoid-acting, or pneumatic-acting, as desired. Such an operating mechanism 20 constitutes no part of present invention.

Generally, the operation of the main-power interrupting unit 22 is a rotation of the main operating shaft 18, which causes downward opening movement of a movable contact-operating rod 24, the latter being connected by a metallic spider arrangement (not shown) to force downward movement of the movable operating cylinder 12, movable contact 14 and movable orifice 13, thereby compressing gas within the region 28 between the movable operating cylinder 12 and the stationary piston structure 10. This compressed gas is forced upwardly past the metallic spider, through the insulating nozzle 13 to effect extinction of the main power arc 30 (see FIG. 2). A general description of the manner of such gas-"puffer" operation is set forth in U.S. Pat. Nos. 3,602,670—Teijeiro; 3,679,851—Latour et al; and W.E. No. 46,073—Cromer et al.

Figure 13:
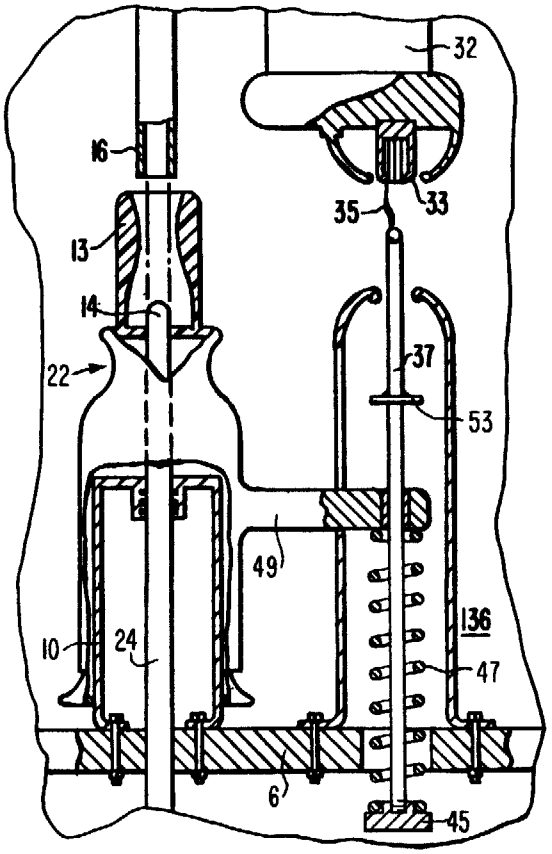
FIG. 13 is a view similar to FIG. 12, with the capacitor contacts opening.
Figure 12:
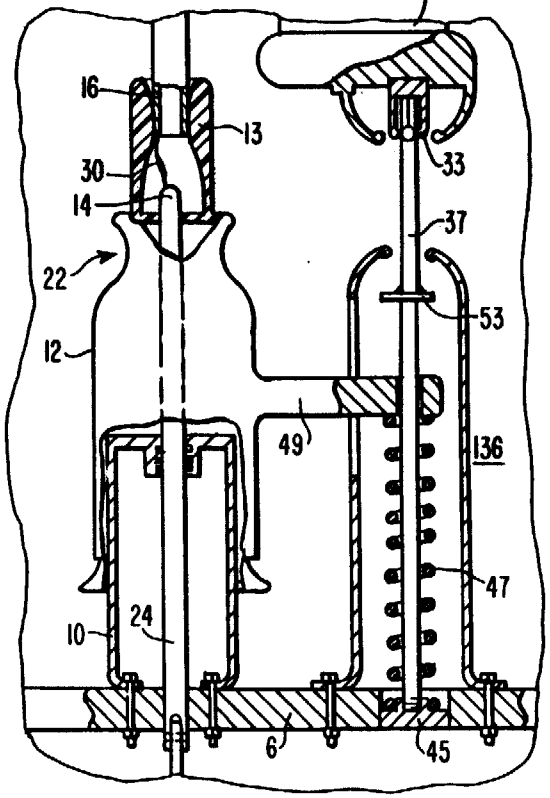
FIG. 12 illustrates a detailed view of one power unit with the capacitor-contacts closed and the main power contacts in the opening position.

The present invention is particularly concerned with the use of a shunting capacitance 32, which has its own series capacitance-isolating contacts 33. FIG. 2 illustrates the separable capacitance contacts 33 in their fully-open-circuit position and FIG. 4 shows the interrupting unit in an electrical schematic. It is desirable to effect a prior opening of the main separable contacts 14, 16 before the subsequent separation of the capacitor-isolating contacts 33, as shown in FIGS. 12 and 13. In this manner, the capacitance 32 is available to lower the rate-of-rise of the recovery-voltage transient, thereby enabling the main-power interrupting arc 30 to be more easily interrupted.

At a subsequent point in time, the isolating capacitance contacts 33, 37 are separated, thereby interrupting the shunting capacitance current. The position of the capacitance arc 35 is illustrated in FIG. 13.

To ensure that the capacitance contacts 33 remain closed, while the main-power interrupting contacts 14, 16 open, drawing the power arc 30, a lost-motion mechanical arrangement 36 must generally be provided. As illustrated more clearly in FIG. 3, the movable-capacitance isolating switch-contact 37 is latched in the closed-circuit position by the rotatable latch-arm 39, biased by a spring 41 in a counterclockwise direction of rotation, and having its latching nose portion 43 under a spring-seat 45, which accommodates a compression spring 47, interposed between the spring-seat 45 and the underside of a laterally-extending actuating arm 49, in this example integrally formed with the movable operating cylinder 12.

Also extending downwardly through the actuating arm 49 is an adjustable "kick-off" stud 51, which effects release of the latching lever 39, in a manner illustrated in FIG. 3. FIG. 3 illustrates the position of the several parts during an intermediate portion of the opening operation, at which time the latch-arm 39 is about to be released, thereby effecting quick-opening movement of the movable isolating capacitance contact 37 under the biasing action exerted by the compression spring 41.

During the closing operation, the operating mechanism 20 effects a reverse rotation of the main operating shaft 18, thereby activating through the floating link 21, an upward, driving, closing operation of the main movable contact-rod 24. This, of course, carries the movable operating cylinder 12 upwardly in a closed direction, and also carries the actuating arm 49 upwardly. The latter strikes the stop plate 53, affixed to the movable isolating contact 37, and carries the latter upwardly therewith to effect generally simultaneous closing of both the separable main-power interrupting contacts 14, 16 and also the separable capacitance contacts 33, 37 to the position illustrated in FIG. 1.

FIG. 5 illustrates a modified-type of lost-motion arrangement 136, in which the latching device of FIG. 3 is eliminated, and merely the frictional interengagement between the separable capacitance isolating contacts 33, 37 maintains them in their closed-circuit position, following the opening of the main-power interrupting contacts 14, 16. The downward opening movement of the actuating arm 49 may either force the compression spring 47 "solid", and thereby forcibly effect downward movement of the movable isolating contact 37, or, alternatively, if desired, the spring 47 may be so compressed as to effect opening of the separable capacitance contacts 33, 37 by spring action instead of an abutment action.

Obviously, in the closed-circuit position of the device of FIG. 5, the stop-plate 53 will abut the upper side of the actuating arm 49 and the closing operation will ensue as before, carrying both movable contacts 14, 37 upwardly during such a closing operation to the closed-circuit position, as illustrated in FIG. 1 of the drawings.

Figure 6:
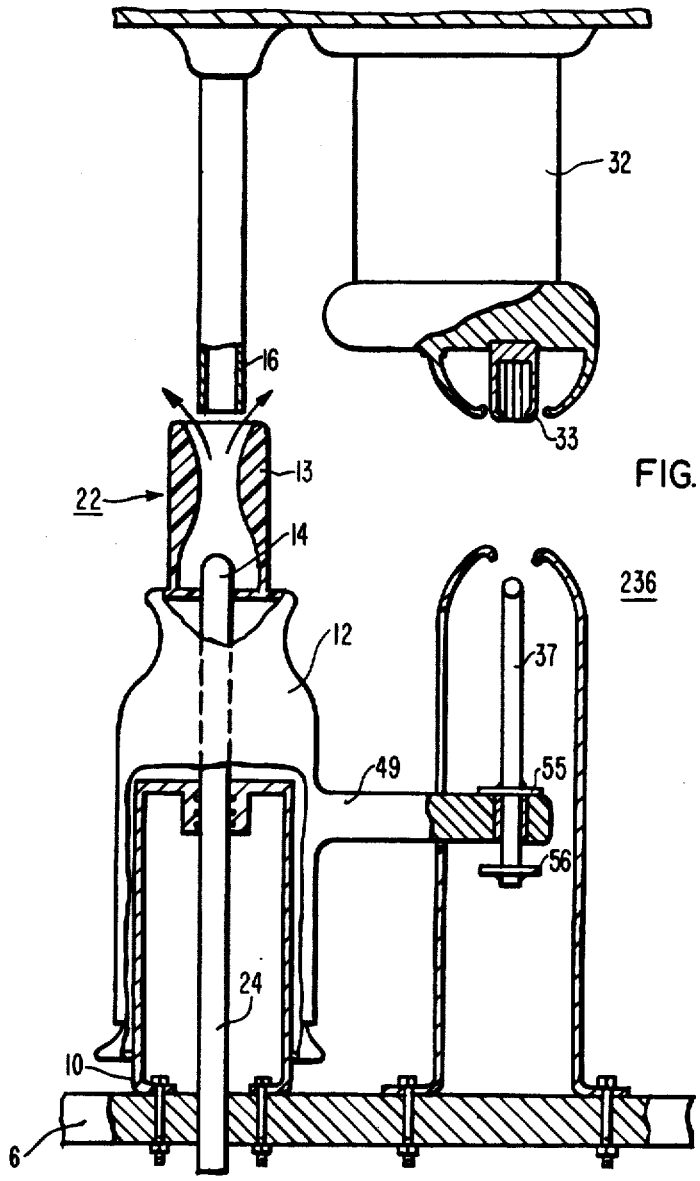
FIG. 6 illustrates still a further lost-motion arrangement, in connection with the movable-capacitor isolating contact, wherein frictional engagement between the separable capacitance switch contacts provides a desirable time-lag.

FIG. 6 illustrates still another alternate arrangement for providing a lost-motion connection 236 between the separable capacitance-isolating contact 37 and the laterally-extending actuating arm 49. Here, no compression spring need be provided and the inertia of the movable-isolator contact 37 may be relied upon for the lost-motion travel. As shown in FIG. 6, a pair of vertically-spaced stop-plates 55, 56, are secured to the movable isolator contact 37, and during the opening operation, the inertial of the movable isolator contact 37 may be relied upon for the desired lost-motion travel of this contact. The closing operation will, of course, transpire, as illustrated heretofore in connection with FIGS. 3 and 5 of the drawings.

Figure 7:
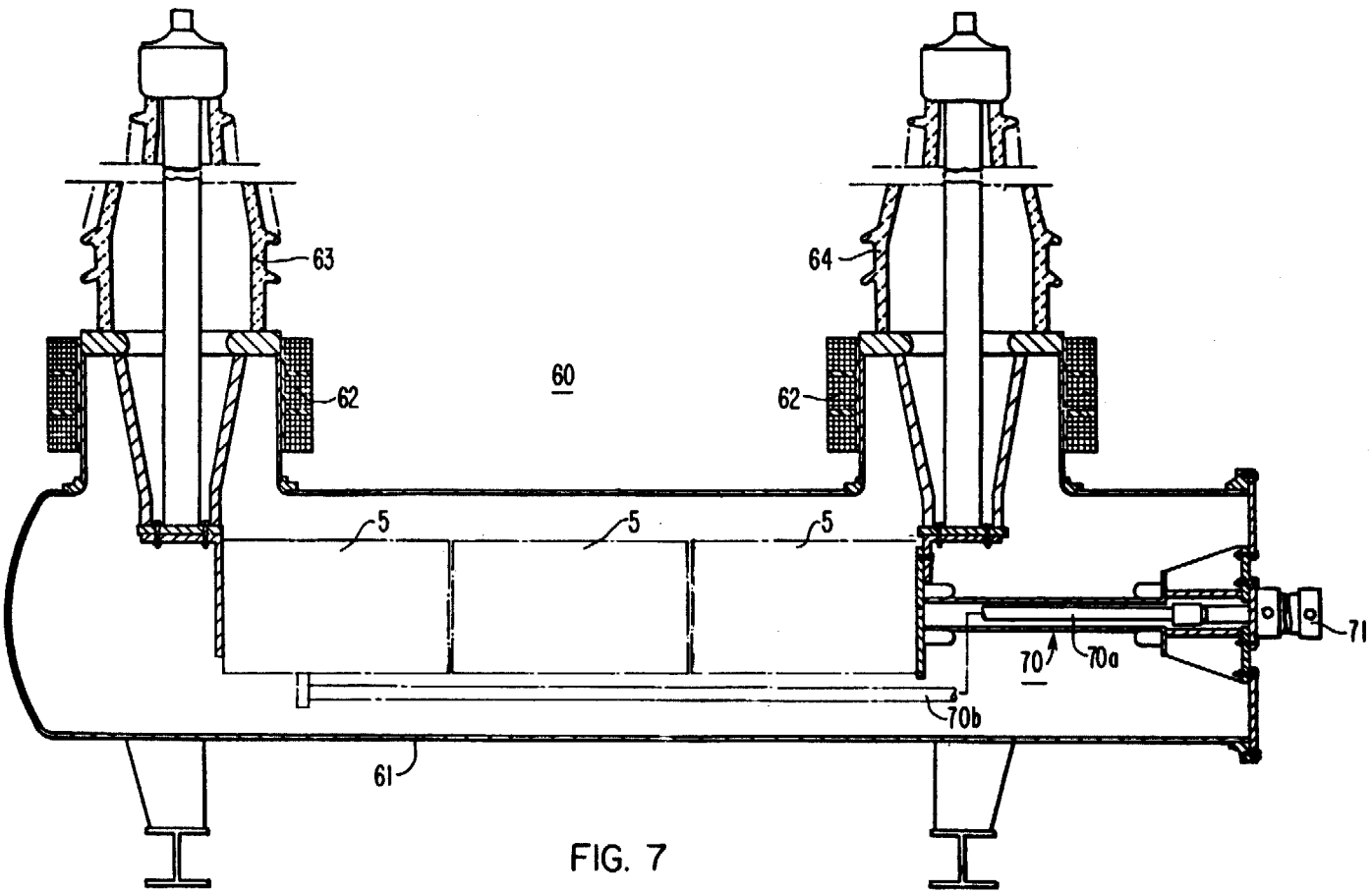
FIG. 7 illustrates a modification of the present invention involving a number of series power breaks, the device being illustrated in the closed-circuit position.

For higher current and/or voltage ratings, series power units 5 are desirable to divide the higher recovery voltages, so that each power unit 5 may be required to interrupt the current and recover only a segmental portion of the total recovery voltage. FIG. 7 shows a high-voltage circuit interrupter 60 in the form of a horizontal, "dead"-tank-type of structure, in which a longitudinally-extending grounded metallic tank 61 is provided. Current transformers 62 may, as shown, surround the terminal-bushings 63, 64, which extend upwardly from opposite ends of the metallic tank structure 61. An operating rod structure 70, of generally, a ladder-type operating arrangement may be actuated from an externally-provided mechanism 71, the latter not constituting any part of the present invention.

Figure 8:
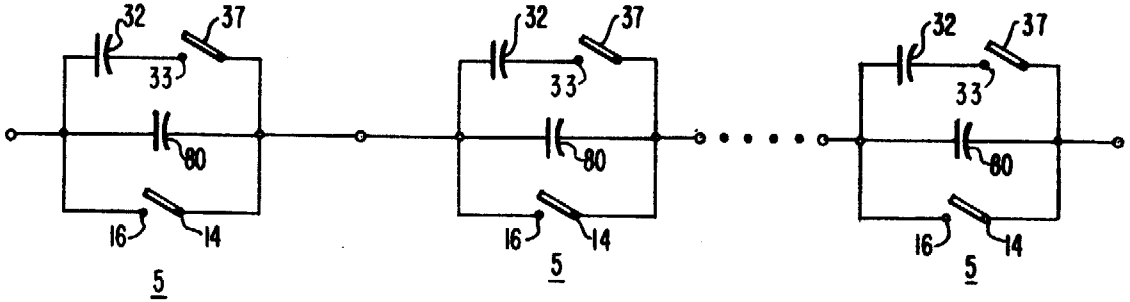
FIG. 8 is a schematic view of the multiple-unit circuit arrangement illustrated in FIG. 7.
Figure 9:
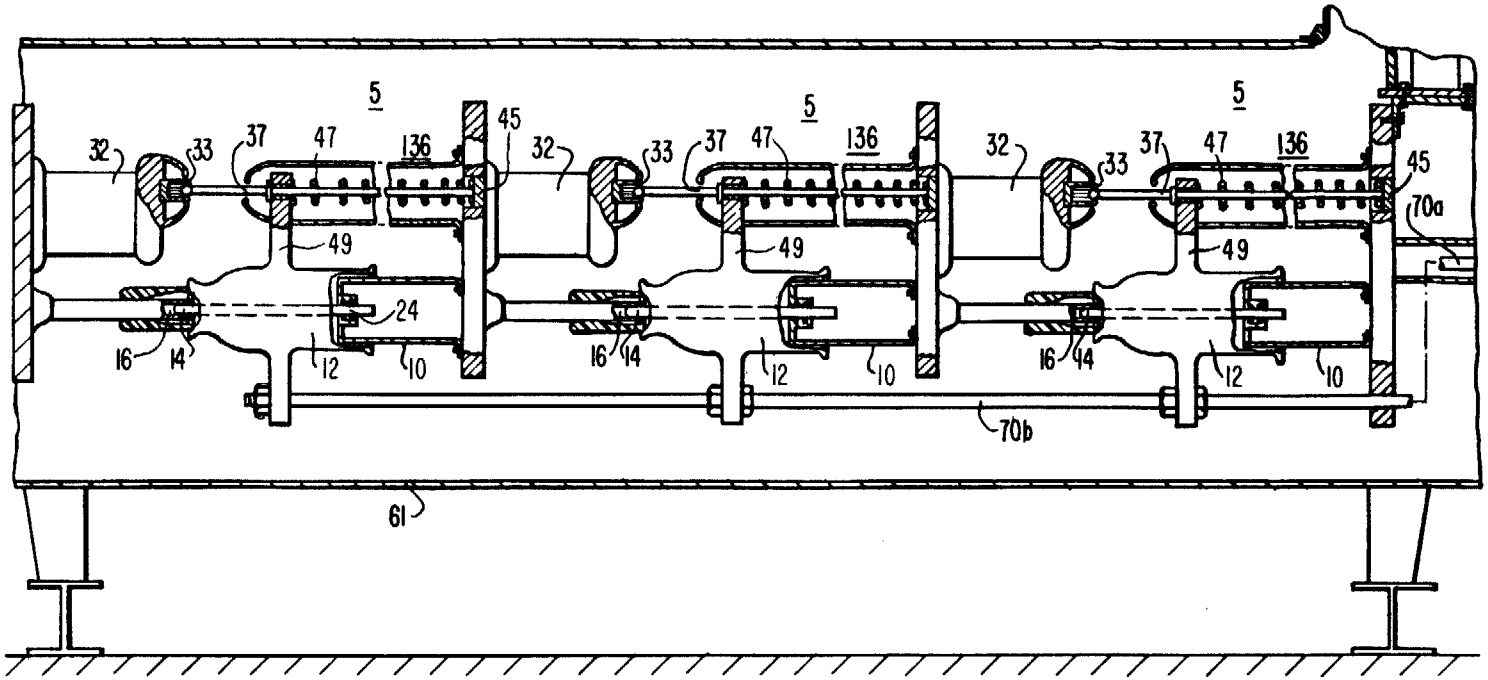
FIG. 9 illustrates, fragmentarily, a sectional view of the high-voltage modification of FIG. 7.
Figure 10:
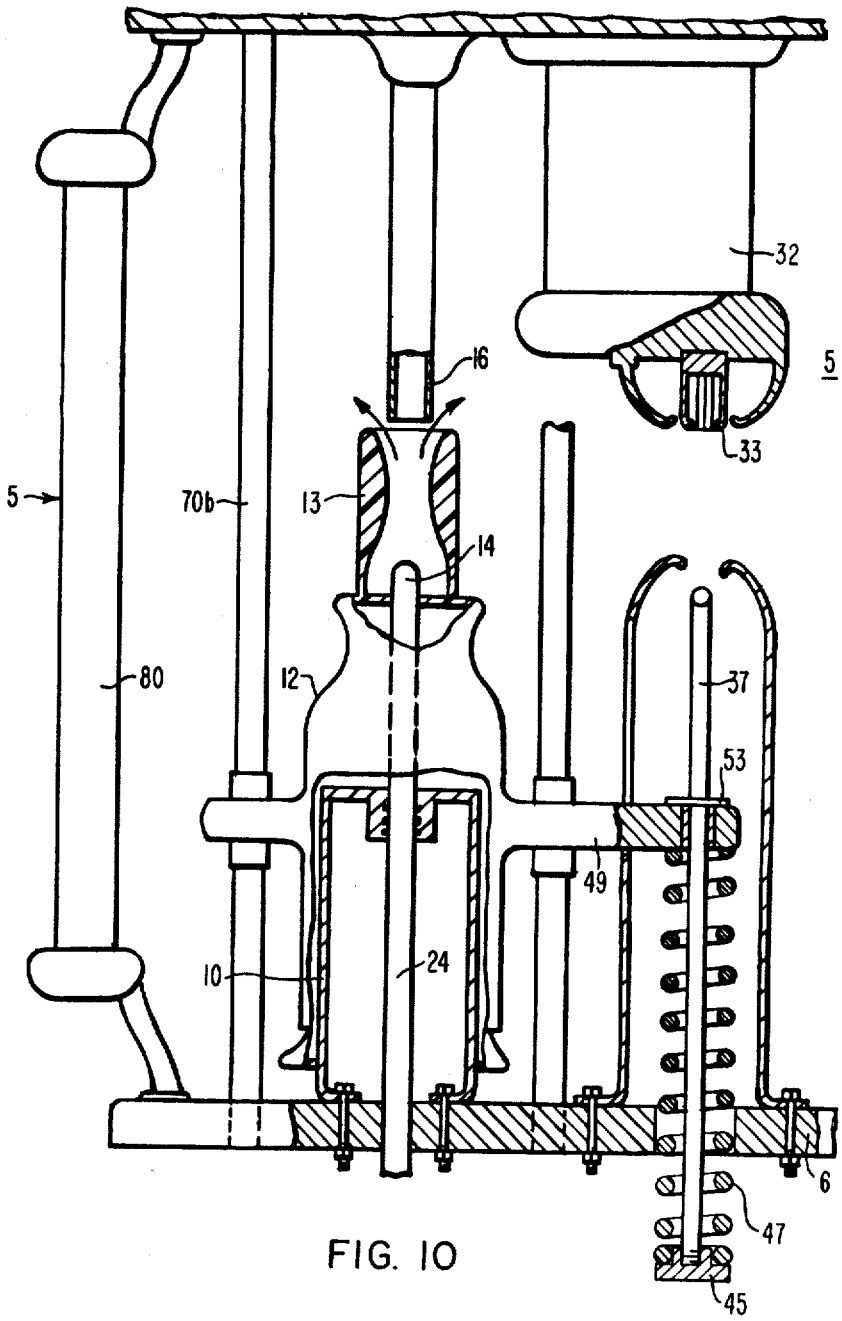
FIG. 10 illustrates, to an enlarged scale, one of the series power units of FIGS. 7 and 9, with the separable contacts illustrated in the open-circuit position.

Generally, with reference to FIGS. 7 and 9, leftward closing motion of the two spaced operating rods 70*a*, 70*b* will effect corresponding closing of the interrupting structure 60, and a simultaneous closing of all the three power-units 5, together with their shunting capacitor units; and rightward opening motion of the two laterally-spaced operating-rods 70*a*, 70*b* will effect corresponding simultaneous opening of the three power-units 5. This opening position is schematically illustrated in FIG. 8. It will be understood that each of the three power units 5 is identical to the interrupter construction, as illustrated in FIG. 10. To forcibly cause an equal division of the open-circuit voltage across the several interrupting power-units, additional voltage-dividing capacitance elements 80 may be utilized across each of the three power-interrupting units 5 to cause an equal divison of open-circuit voltage between them. These shunting capacitance elements are indicated by the reference numeral 80 in FIG. 10. The opening and closing operations of the power-units 5 and their shunting capacitor units 32 is as described heretofore in connection with FIGS. 2 and 5, and this detailed description will not be repeated.

Suffice it to say, rightward opening operation of the two laterally-spaced operating rods 70*a*, 70*b* will effect a prior opening of the power-interrupting units 5, drawing the power arcs in series, each of which is shunted by its own individual, respective, relatively-heavy capacitance 32. At a later point in time, following interruption of the main-power units, the lost-motion associated with the capacitance-isolating switch will be taken up, and the separable isolating capacitance contacts 33, 37 will be opened, as described heretofore.

Figure 11:
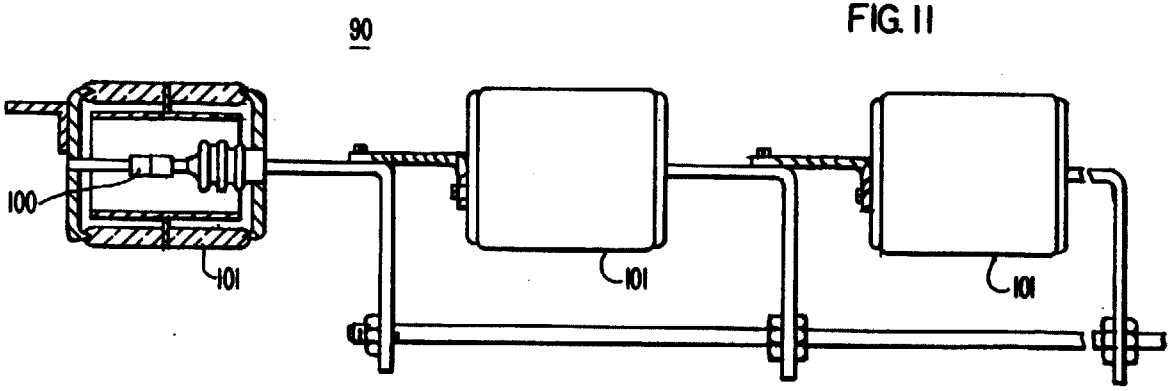
FIG. 11 illustrates an application of the present invention to a high-voltage circuit, involving a plurality of series vacuum-interrupter units.

FIG. 11 illustrates an interrupter construction 90 involving series main-power units of the vacuum-type, which may be substituted for the "puffer" units in FIGS. 7 and 9. As well understood by those skilled in the art, the separable vacuum-type power contacts 100 are separated in an evacuated enclosure, or envelope 101, and the power-arcs are easily interrupted by virtue of the fact that no gas molecules are present within the evacuated enclosure 101. Reference may be made to the following U.S. patents for a general description of the method of arc interruption within a vacuum-type interrupting unit, or vacuum "bottle": U.S. Pat. No. 3,283,100—Frink; U.S. Pat. No. 3,090,852—Greenwood; and U.S. Pat. No. 3,089,936—Smith.

It will be understood that the substitution of the vacuum "bottles" for the single-pressure gas puffer-type interrupting units, as illustrated in FIG. 11, illustrates the wide applicability of the present invention. It is merely desired to effect interruption of the main-power arcs by some effective arc-extinguishing means, which may assume the form of a forced gas flow through an insulating nozzle 13, as in FIG. 2, or alternatively, the interruption of such a power-arc may occur within an evacuated casing 101, as utilized in the vacuum-type interrupting elements, illustrated in FIG. 11.

Although there have been illustrated and described specific embodiments, it is to be clearly understood that the same were merely for the purpose of illustration, and that changes and modifications may readily be made therein, by those skilled in the art, without departing from the spirit and scope of the invention.

What we claim is:

1. A compressed-gas-type of arc-extinguishing assemblage comprising a main-power interrupting unit having a pair of separable main-power interrupting contacts, means for causing the separation of the main-power separable contacts to establish an arc therebetween, means forcing a blast of compressed gas against said established power-arc to effect the extinction thereof, means defining a shunting capacitance and its serially-related isolating separable capacitance contacts disposed in electrically parallel arrangement to said power-interrupting unit, means for causing the separation of the isolating capacitance separable contacts following the previous separation of the separable main-power contacts, and means for effecting simultaneous closing of said main-power and isolating capacitance contacts during a closing position.

2. The combination according to claim 1, wherein the source of compressed gas is obtained by relative movement of a movable operating cylinder, carrying the movable main power contact, and slidable over a relatively-stationary piston structure.

3. The combination according to claim 2, wherein an actuating arm, movable with the movable operating cylinder, has a lost-motion mechanical connection with the movable capacitance isolating contact, whereby the movable isolating capacitance contact is picked up by said movable arm at a predetermined point in the opening operation of the circuit-interrupter assemblage.

4. The combination according to claim 1, wherein a latching means holds the movable isolating capacitance contact in its closed-circuit position, and releasing means associated with said movable arm effects release of said latching means to enable opening operation of the movable isolating capacitance contact, and biasing means is provided to bias the movable capacitance isolating contact to its fully-open-circuit position.

5. The combination according to claim 3, wherein the movable isolating capacitance contact passes through an aperture provided in the movable arm, and has a pair of spaced stop plates secured thereto, one of said spaced stop plates affording a spring-seat for a spring-biasing means interposed between said spring-plate and one side of the movable actuating arm.

6. The combination according to claim 5, wherein additional latching means is provided to latch the spring-plate in a closed-circuit position, and releasing means movable with said movable actuating arm effects release of said latching means.

7. The combination according to claim 1, wherein the frictional engagement between the separable isolating capacitance contacts causes a later opening of the capacitance contacts than the separation of the main-power interrupting contacts, whereby the main-power arc is beneficially affected by the presence of the shunting capacitance.

8. In combination, a plurality of serially-related vacuum-type interrupting power-units, each of said vacuum-type interrupting power-units having its individual pair of separable power-contacts, each of said vacuum-interrupter power units being shunted by a series circuit combination of a capacitance and a serially-related separable isolating capacitance contacts, means for causing the simultaneous opening of the main-power interrupting contacts of all of the vacuum-type power-units and a subsequent opening in point of time of the shunting separable capacitance contacts, and means for effecting simultaneous closing of said power-contacts and said isolating capacitance contacts during a closing operation.

9. The combination according to claim 8, wherein an actuating arm is associated with each of the movable contacts of the several vacuum-type interrupting elements, and the movable isolating capacitance contact has a lost-motion mechanical connection with its respective actuating arm, whereby the capacitance contacts are opened at a later point in time than the prior opening of the power-interrupting contacts of the respective vacuum-type interrupting unit.

10. In combination, a plurality of serially-related compressed-gas power-interrupting units arranged in electrical series for interrupting relatively high recovery voltages, each of said compressed-gas units including an electrically shunting circuit including a capacitance and a serially-related pair of separable capacitance isolating contacts, means for opening the main-power contacts of each of the compressed-gas units, means for effecting gas flow at each of the power arcs drawn at said main compressed-gas power-interrupting units, means providing a subsequent opening of the separable isolating capacitance contacts at a later point of time following the previous separation of the main-power interrupting contacts, and means for effecting simultaneous closing of said main-power and isolating capacitance contacts during a closing operation.

11. The combination according to claim 10, wherein an arm is associated with each of the compressed-gas power-interrupting units, and the separable contacts are actuated by a lost-motion mechanical connection to the respective arm.

12. In combination, a puffer-type compressed-gas circuit-interrupting assemblage including a main-power unit and an electrically parallel capacitance unit, the main-power unit including a relatively stationary contact, a relatively stationary piston structure, a movable operating cylinder movable over said relatively fixed piston structure and carrying the movable power contact, an operating arm extending laterally from the movable operating cylinder, the movable capacitance isolating contact having a lost-motion mechanical connection with respect to said arm, whereby the pair of separable isolating contacts separates subsequent in point of time to the previous separation of the main-power interrupting contacts of the individual puffer-type interrupting unit, and means for effecting simultaneous closing of said main-power interrupting contacts and said isolating contacts during a closing operation.

13. The combination according to claim 12, wherein the movable isolating capacitance contact extends through an aperture in said movable arm.

14. The combination according to claim 12, wherein latching means is associated with said lost-motion mechanical connection to latch the movable isolating contact in its closed-circuit position.

* * * * *